United States Patent [19]

Kropiwnicki et al.

[11] Patent Number: 4,477,229

[45] Date of Patent: Oct. 16, 1984

[54] COMPRESSOR ASSEMBLY AND METHOD OF ATTACHING A SUCTION MUFFLER THERETO

[75] Inventors: Tadek M. Kropiwnicki, Syracuse; Linda E. Cross, Liverpool, both of N.Y.

[73] Assignee: Carrier Corporation, Syracuse, N.Y.

[21] Appl. No.: 411,204

[22] Filed: Aug. 25, 1982

[51] Int. Cl.[3] ..... F04B 11/00; F04B 21/00

[52] U.S. Cl. ..... 417/53; 181/403; 417/312; 417/902

[58] Field of Search ..... 417/312, 363, 902, 415, 417/419; 181/403; 62/296

[56] References Cited

U.S. PATENT DOCUMENTS

| | | | |
|---|---|---|---|
| 3,044,688 | 7/1962 | Frank et al. | 417/902 |
| 3,817,661 | 6/1974 | Ingalls et al. | 417/312 |
| 3,864,064 | 2/1975 | Gannaway | 417/312 |
| 4,209,080 | 6/1980 | Douglas | 184/6.16 |
| 4,239,461 | 12/1980 | Elson | 417/312 |
| 4,396,359 | 8/1983 | Kropiwnicki | 417/902 |
| 4,401,418 | 8/1983 | Fritchman | 417/312 |

*Primary Examiner*—Edward K. Look

*Attorney, Agent, or Firm*—David J. Zobkiw

[57] ABSTRACT

A compressor and a method of assembling a compressor. The compressor comprises a central section, a cylinder head, and a suction muffler. The cylinder head of the compressor is secured to the central section thereof, and the cylinder head defines a muffler recess including a locking portion. The suction muffler extends into and is secured within the muffler recess in pressure engagement with the surfaces of the cylinder head defining the muffler recess. The suction muffler includes a locking flange extending into the locking portion of the muffler recess to limit movement of the suction muffler away from the cylinder head.

9 Claims, 10 Drawing Figures

COMPRESSOR ASSEMBLY AND METHOD OF ATTACHING A SUCTION MUFFLER THERETO

BACKGROUND OF THE INVENTION

This invention generally relates to compressors, and more specifically to compressors employing suction mufflers to attenuate sound waves generated within the compressors.

Compressors are commonly employed in refrigeration and air conditioning equipment to compress a refrigerant vapor. Commonly, a compressor includes a cylinder block, a plurality of cylinder heads, a rotatable crankshaft, and a plurality of pistons. The compressor crankshaft is rotatably supported by the cylinder block, and the cylinder block defines a plurality of cylinder chambers. The compressor pistons are reciprocally disposed within these cylinder chambers and are also connected to the compressor crankshaft via conventional wrist pins and connecting arms. The cylinder heads cover the cylinder chambers and define suction plenums for conducting vapor thereinto and discharge plenums for receiving compressed vapor therefrom. Suction and discharge valves are positioned between the cylinder chambers and the suction and discharge plenums to control vapor flow therebetween.

Often, a compressors of the general type outlined above is utilized as part of a motor-compressor unit that, in addition to the compressor, includes a motor and a shell enclosing both the compressor and the motor. In operation, the shell of the motor-compressor unit is filled with low pressure suction vapor, the motor is employed to rotate the compressor crankshaft, and rotation of the crankshaft reciprocates the compressor pistons within the cylinder chambers. As these pistons reciprocate, vapor is drawn through the suction plenums defined by the cylinder heads and into the cylinder chambers, compressed therein, and then directed into the discharge plenums of the cylinder heads. Therefrom, the compressed vapor is conducted from the compressor and from the shell of the motor-compressor unit via a vapor discharge line. As is well understood in the art, the suction and discharge valves cyclically open and close to insure that vapor flows in the proper sequence from the suction plenum into the cylinder chambers and from the cylinder chambers into the discharge plenums.

This cyclic opening and closing of the suction valves generates pressure pulses in the vapor flow path leading to the suction valves. These pressure pulses may be transmitted along this vapor flow path to the shell of the motor-compressor unit, and the shell may transmit these pressure pulses to the ambient, producing undesirable noise. In order to dissipate these pressure pulses and to prevent the concomitant noise, compressors of the general type discussed above are often provided with mufflers, commonly referred to as suction mufflers. The suction mufflers are connected to the cylinder heads of the compressor, define fluid flow paths to conduct vapor into the suction plenums of the cylinder heads, and, in operation, diffuse the pressure pulses developed by the suction valves, substantially reducing any noise generated thereby.

Heretofore, these suction mufflers have been formed from a metal and usually are either integral with or bolted to the cylinder heads or the cylinder block of the compressor. While these mufflers perform very satisfactorily, they have a number of disadvantages. Principally, the raw material and the process of forming the mufflers are both costly. Moreover, metal suction mufflers, being good conductors of heat, conduct some heat from the discharge plenums of the cylinder heads to the vapor flowing through the mufflers, heating that vapor. This may have a slight adverse affect on the performance of the compressor.

SUMMARY OF THE INVENTION

In view of the above, an object of the present invention is to provide a relatively inexpensive muffler for a compressor.

Another object of this invention is to secure a suction muffler within a compressor by means of pressure contact between the muffler and adjacent surfaces of the compressor.

A further object of the present invention is to provide a compressor suction muffler having improved thermal characteristics.

These and other objects are attained with a compressor comprising a central section, a cylinder head, and a suction muffler. The central section of the compressor defines a cylinder chamber. The cylinder head of the compressor is secured to the central section thereof, and defines a suction cavity and a muffler recess. The suction cavity of the cylinder head is in communication with the cylinder chamber of the central section of the compressor, and the muffler recess includes a locking portion extending beneath a locking surface of the cylinder head. The suction muffler extends into and is secured within the muffler recess in pressure engagement with the surfaces of the cylinder head defining the muffler recess, and the suction muffler defines a fluid flow path for conducting vapor into the suction cavity of the cylinder head. The suction muffler includes flange means extending into the locking portion of the muffler recess, beneath the locking surface of the cylinder head, to limit movement of the suction muffler away from the cylinder head.

BRIEF DESCRIPTIONS OF THE DRAWINGS

DETAILED DESCRIPTION OF THE PREFERRED EMBODIMENT

Figure 1:
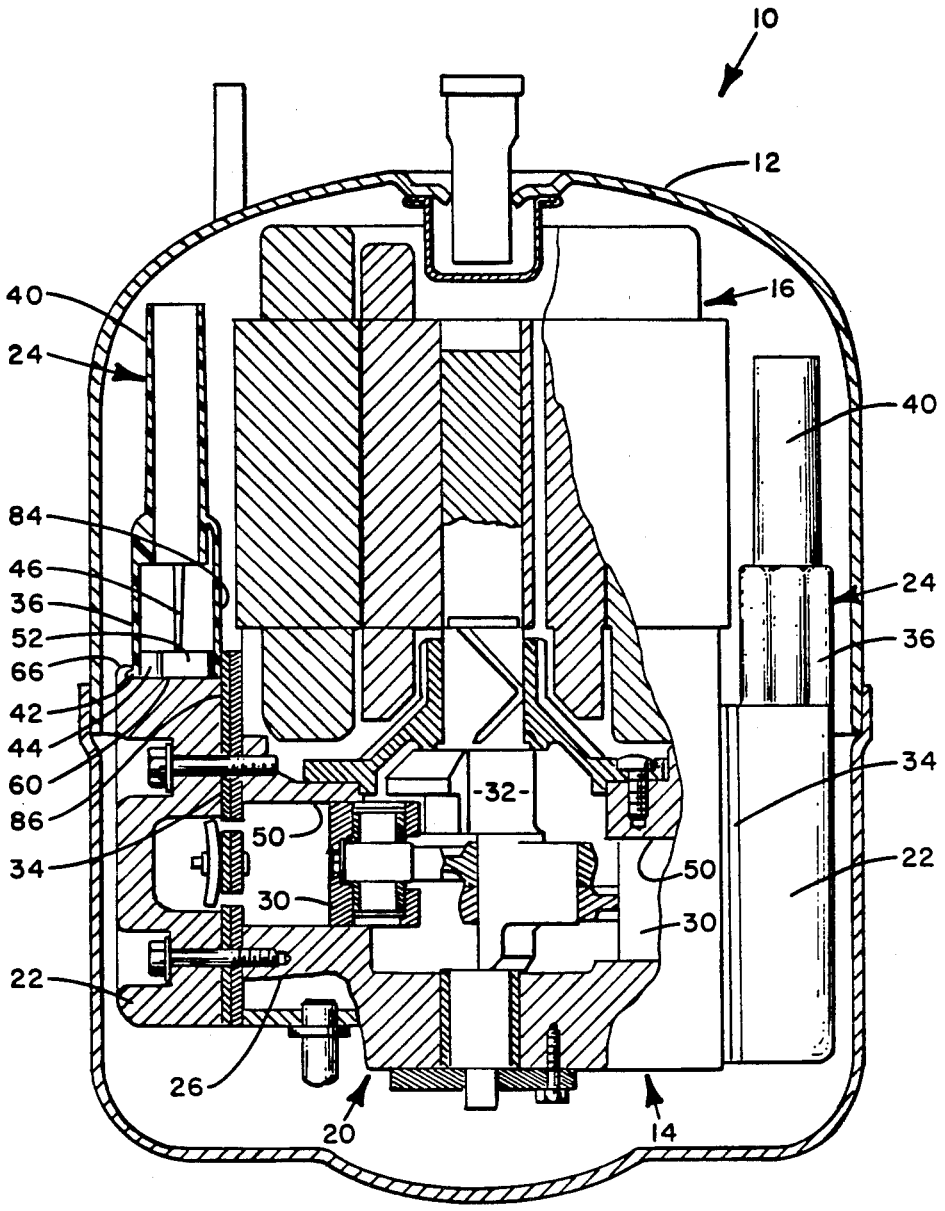
FIG. 1 is a side view, primarily in cross section, of a motor-compressor unit employing a compressor constructed in accordance with a preferred embodiment of the present invention.

Particularly referring to FIG. 1, there is disclosed motor-compressor unit 10 including shell 12, compressor 14, and motor 16. Shell 12 and motor 16 may be of a conventional nature and will be briefly described subsequently. Compressor 14, though, is constructed in accordance with a preferred embodiment of the present invention and will herein be discussed in detail.

Generally, compressor 14 comprises central section 20, and one or more cylinder heads 22 and suction mufflers 24. More particularly, central section 20 of compressor 14 includes cylinder block 26, a plurality of pistons 30, crankshaft 32, and valve plates 34. Each suction muffler 24 includes body 36, inlet portion 40, and flange means 42, and each suction muffler preferably further includes resilient member 44 and stop 46.

Central section 20 of compressor 14, specifically cylinder block 26 thereof, defines one and preferably a plurality of cylinder chambers 50, and pistons 30 are disposed within these cylinder chambers and are supported by the cylinder block for reciprocal movement within the cylinder chambers. Compressor crankshaft 32 is rotatably supported by cylinder block 26 and is connected to pistons 30, for instance by means of conventional connecting arms and wrist pins, to reciprocate the pistons within cylinder chambers 50.

Cylinder heads 22 are secured to central section 20 of compressor 14, particularly to cylinder block 26, by means such as a plurality of bolts, and the cylinder heads cover cylinder chambers 50 and define suction cavities (not shown) and discharge cavities in communication with the cylinder chambers. Preferably, valve plates 34 are located between cylinder block 26 and cylinder heads 22; and the valve plates define suction inlets, which communicate the suction cavities of the cylinder heads with cylinder chambers 50, and discharge outlets, which communicate the cylinder chambers with the discharge cavities of the cylinder heads. Conventional suction and discharge valves may be connected to valve plates 34 to control vapor flow through the suction inlets and the discharge outlets defined thereby.

Referring now to FIGS. 1 through 4 and 8 through 10, each cylinder head 22 also defines muffler recess 52 including locking portion 54 extending beneath locking surface 56 of the cylinder head. With the embodiment of compressor 14 illustrated in the drawings, muffler recess 52 of each cylinder head 22 is defined by top surface 60 thereof and by left, right, and the back lips 62, 64, and 66 extending upward from this top surface; and locking portion 54 of each muffler recess comprises left, right, and back sockets 70, 72, and 74, which extend outward into the left, right, and back lips of the cylinder head, away from the center of the muffler recess defined thereby. The surfaces of lips 62, 64, and 66 forming the upper boundaries of left, right, and back sockets 70, 72 and 74, it should be noted, comprise the above-mentioned locking surfaces 56 of cylinder heads 22.

Suction mufflers 24 extend into and are secured within muffler recesses 52 in pressure engagement with the surfaces of cylinder heads 22 defining the muffler recesses, and the suction mufflers define fluid flow paths for conducting vapor into the suction cavities of the cylinder heads. Further, flange means 42 of suction mufflers 24 extend into locking portions 54 of muffler recesses 52, beneath locking surfaces 56 of cylinder heads 22 to limit movement of the suction mufflers away from the cylinder heads. Preferably, muffler flange means 42 are in a tight pressure fit with locking surfaces 56 of cylinder heads 22, securely holding suction mufflers 24 against movement away from the cylinder heads.

Describing suction mufflers 24 in greater detail, particularly referring now to FIGS. 1 through 5 and 7, bodies 36 of the suction mufflers engage and extend upward from top surfaces 60 of cylinder heads 22, and the suction muffler bodies define substantially hollow interiors and open bottoms for conducting fluid through the bodies of the suction mufflers and into the interiors of cylinder heads 22. Tubular inlet portions 40 of suction mufflers 24 extend through and upward from the tops of bodies 36 thereof, and the muffler inlet portions define open top and bottom ends to conduct fluid into the interiors of the suction muffler bodies. As is believed best understood from FIGS. 8 through 10, flange means 42 of suction mufflers 24 extend outward from lower portions of bodies 36; and preferably this flange means of each suction muffler includes left, right, and back flanges 76, 80, and 82 extending outward from left, right, and back sides of the suction muffler body, into left, right, and back sockets 70, 72, and 74 of the cylinder head 22 receiving the suction muffler, in a generally complementary fit with the surfaces of the cylinder head defining these openings. Suction mufflers 24 are formed from a resilient material, preferably plastic, with the body 36, tubular inlet portion 40, and flanges 76, 80 and 82 of each suction muffler integral portions of a single piece of material.

Preferably, the pressure engagement between suction mufflers 24 and cylinder heads 22 is developed by squeezing the suction mufflers between central section 20 of compressor 14 and the surfaces of the cylinder heads defining muffler recesses 52. In particular, as described above, the fronts of muffler recesses 52 are open, and suction mufflers 24 are formed from flexible material. In addition, in a partially assembled position, shown in FIGS. 2 and 3, where suction muffler 24 is connected to cylinder head 22 but both the suction muffler and the cylinder head are disconnected from central section 20 of compressor 14, a front surface 84 of the suction muffler extends through the front of the muffler recess 52 defined by the cylinder head and projects forward of top surface 60 thereof. As cylinder head 22 and suction muffler 24 are connected to central section 20 of compressor 14, as shown in FIG. 1, outside surface 86 of the central section of the compressor, specifically an outside surface of a valve plate 34, engages the front surface 84 of the suction muffler and forces the suction muffler outward into, and subsequently holds the suction muffler in, pressure engagement with the surfaces of the cylinder head defining muffler recess 52.

Figure 4:
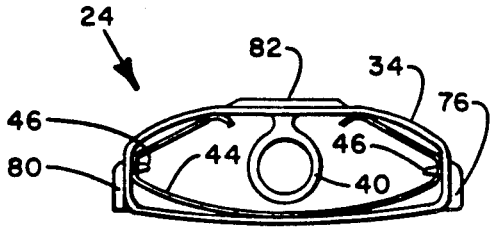
FIG. 4 is a bottom view of the suction muffler, particularly showing an inside resilient member thereof.
Figure 6:
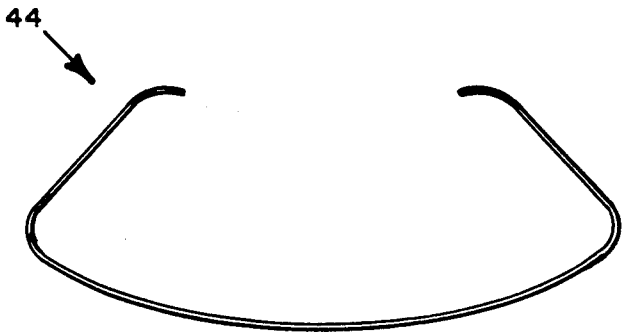
FIG. 6 is a plan view of the resilient member of the suction muffler, with the resilient member in an unassembled, unstressed position.
Figure 7:
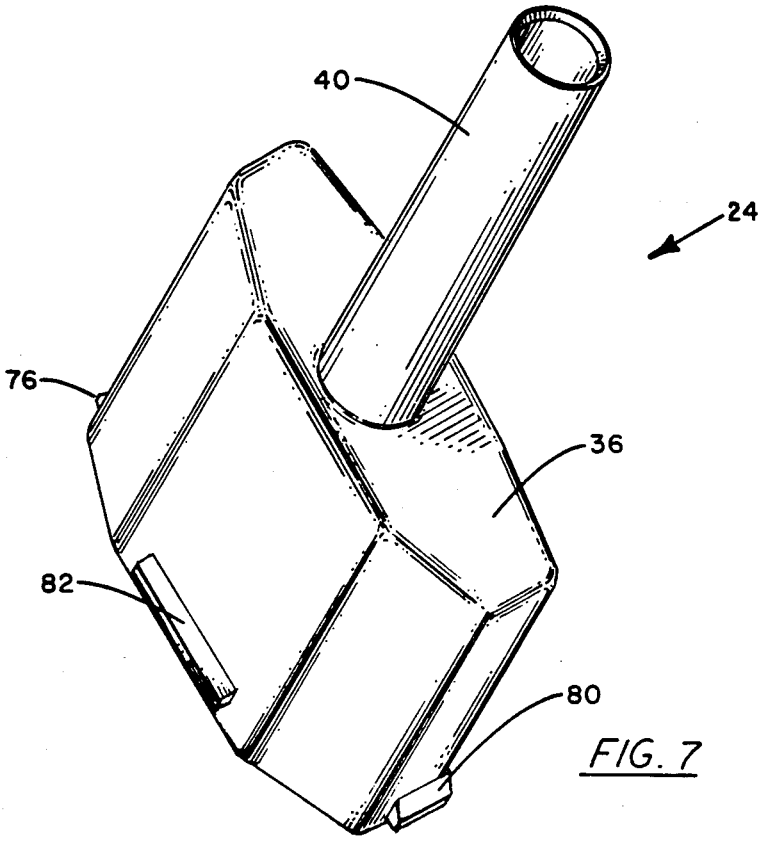
FIG. 7 is a perspective view of the suction muffler.
Figure 8:
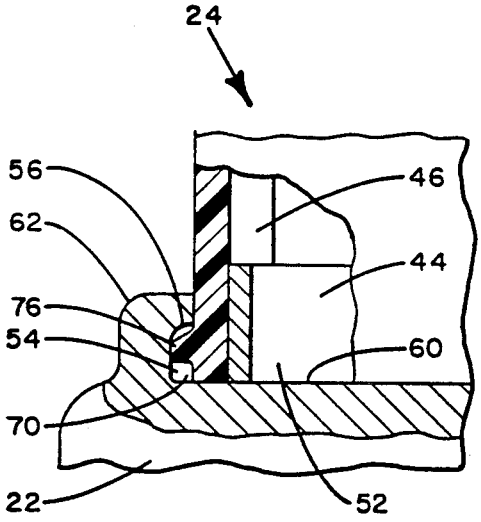
FIGS. 8, 9 and 10 are enlarged portions of FIGS. 2 and 3, showing the lower left, lower right and back central flanges of the suction muffler respectively.
Figure 9:
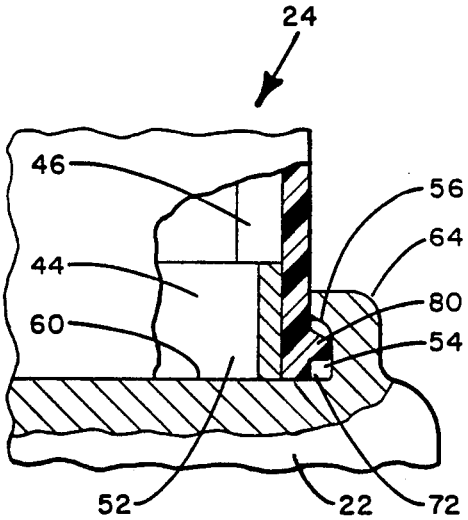
Figure 10:
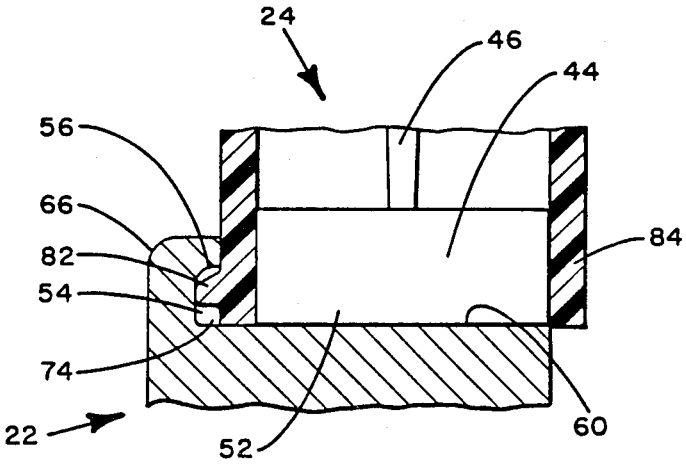

To insure that suction mufflers 24 are tightly held in position, resilient members 44 may be disposed within the lower portions of bodies 36 of the suction mufflers, urging the lower portions of the suction muffler bodies outward against the surfaces of the cylinder heads 22 defining muffler recesses 52, and in particular urging the front sides of the suction mufflers into pressure engagement with central section 20 of compressor 14, specifically valve plates 34. With reference to FIGS. 4 and 6, each resilient member 44 may comprise a thin, resilient metal band having an open, bow shape. With this embodiment of suction mufflers 24, preferably each muffler is provided with stop 46 to limit upward movement of the resilient member within body 36 of the suction muffler. Stop 46 may take the form of a pair of flanges connected to, and preferably integral with, muffler body 36, extending inward, toward the center of suction muffler 24, from transverse sides thereof, and having lower terminal edges slightly spaced from the bottom of the muffler and from top surface 60 of cylinder head 22.

To assemble compressor 14, the lower portions of suction mufflers 24 are positioned within muffler recesses 52 of cylinder heads 22, specifically with muffler flange means 42 positioned within locking portions 54 of the muffler recesses. This may be done, for instance, by placing the bottoms of suction mufflers 24 on surfaces 60 of cylinder heads 22, with flanges 76, 80, and 82 aligned with sockets 70, 72, and 74 respectively; and then sliding the suction mufflers along surfaces 60 of the cylinder heads, sliding flanges 76, 80, and 82 into sockets 70, 72, and 74 of muffler recesses 52. To facilitate this sliding movement, the tops of flanges 76, 80, and 82 of each suction muffler 24 may taper or slope downward in the direction in which the muffler slides, for example from right to left as viewed in FIG. 5.

Next, suction mufflers 24 are squeezed between surfaces of central section 20 of compressor 14 and surfaces of cylinder heads 22 defining muffler recesses 52, and the cylinder heads are secured to central section 20 of compressor 14. This may be done, simply, by placing valve plates 34 over the lower front portions of suction mufflers 24 and the fronts of cylinder heads 22, placing the cylinder heads and the valve plates against cylinder block 26, over cylinder chambers 50, with the valve plates between the cylinder heads and the cylinder block, and then tightly bolting the cylinder heads to the cylinder block. This, of course, tightly secures plates 34 between cylinder heads 22 and cylinder block 26; and, as this is done, the valve plates force the front surface 84 of each suction muffler 24 toward the back thereof, into a position substantially coplanar with the front of the cylinder head to which the suction muffler is connected, tightly securing the suction mufflers between the surfaces of the cylinder heads defining muffler recesses 52 and the central section 20 of compressor 14.

Figure 5:
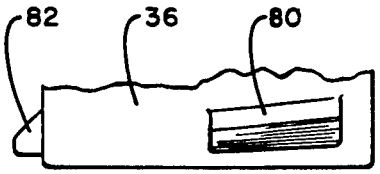
FIG. 5 is an enlarged view of a lower, outside portion of the suction muffler, when the suction muffler is in a disassembled position.
Figure 2:
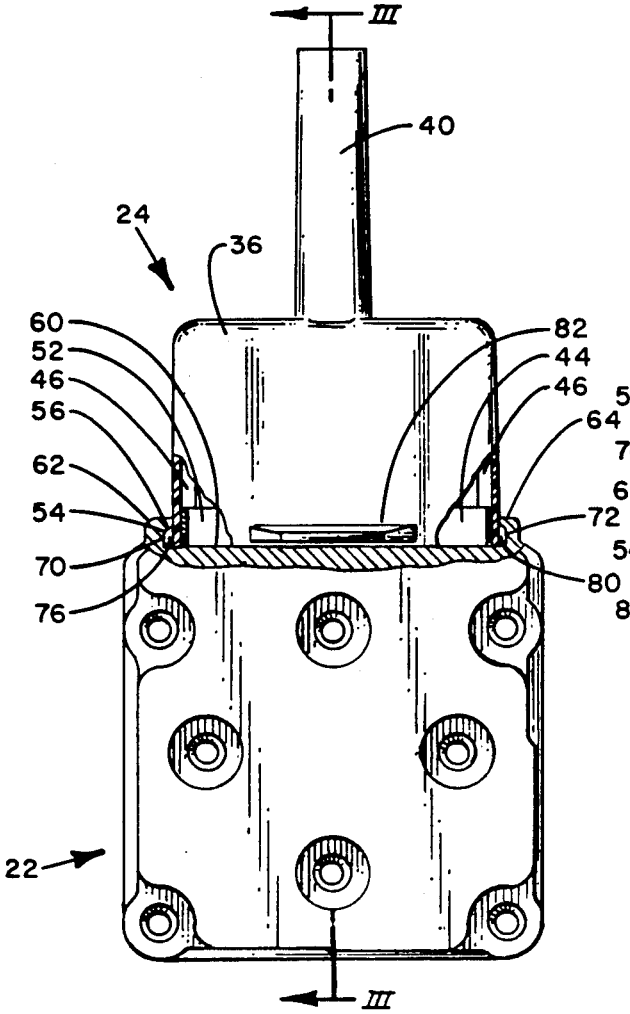
FIG. 2 is a back view of a cylinder head and a suction muffler of the compressor shown in FIG. 1, with portions of the cylinder head and suction muffler broken away.
Figure 3:
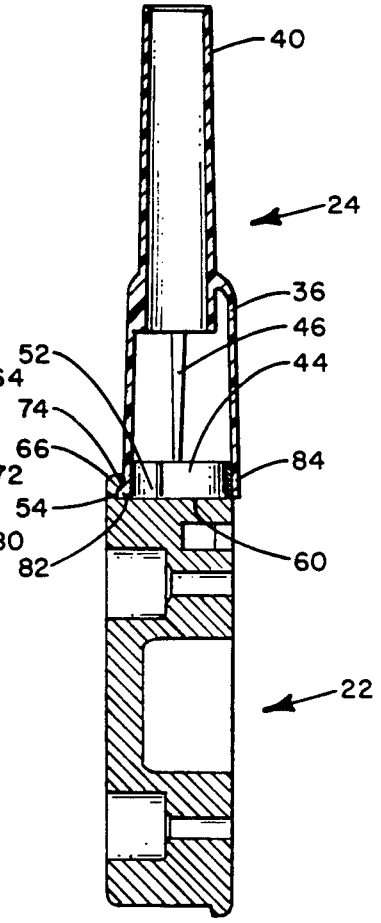
FIG. 3 is a side, cross sectional view of the cylinder head and suction muffler, taken along line III—III of FIG. 2.

Preferably, it should be noted, with particular reference to FIG. 5, in a completely unassembled position, muffler flanges 76, 80, and 82 are spaced from the plane defined by the bottom edges of the bodies 36 of suction mufflers 24 so that, as the suction mufflers are first positioned on top surfaces 60 of cylinder heads 22, flanges 76, 80, and 82 of the suction mufflers are spaced from those top surfaces. This space allows some deformation or downward deflection of muffler flanges 76, 80, and 82 as the flanges move into sockets 70, 72, and 74 of muffler recesses 52 and engage the surfaces forming the top boundary of the locking portions 54 of the muffler recesses. With the preferred embodiment of compressor 14 described above, the assembly of the compressor further comprises the step of inserting resilient members 44 within lower portions of the bodies 36 of suction mufflers 24 to urge the lower portions of the suction muffler bodies outward, and preferably this is done prior to positioning the suction mufflers within muffler recesses 52 of cylinder heads 22.

Thus, as will be understood from a review of the above remarks, suction mufflers 24 may be easily and securely connected within compressor 14. At the same time, suction mufflers 24 may be, and preferably are, formed from a plastic material such as Valox DR-51 which, in comparison to a metal material, has a lower cost and preferred thermal characteristics. Moreover, because mufflers 24 are formed from a plastic, for example via an injection molding process, providing the mufflers with curved or rounded edges and corners, which, in contrast to mufflers having sharp edges and corners, results in better accoustical performance, requires minimal additional expense or time.

Returning to motor-compressor unit 10 shown in FIG. 1, compressor 14 and motor 16 are supported within shell 12, for example via a conventional suspension system, and the motor is connected to crankshaft 32 of the compressor to rotate the crankshaft. Also, a supply of lubricant may be disposed within a lower portion of shell 12, and compressor 14 may be provided with a lubrication system to insure adequate lubrication of the moving parts of the compressor.

In the preferred operation of motor-compressor unit 10, low pressure vapor is conducted into shell 12 via a shell inlet, and motor 16 is actuated to rotate compressor crankshaft 32. Rotation of crankshaft 32 reciprocates pistons 30 within cylinder chambers 50. As pistons 30 so reciprocate, vapor from within shell 12 is drawn into suction mufflers 24 and conducted therethrough, through the suction cavities defined by cylinder heads 22, through valve plates 34, and into cylinder chambers 50. The vapor is compressed within cylinder chambers 50, discharged therefrom into the discharge cavities of cylinder heads 22, and then is conducted from compressor 14 and from shell 12 via a vapor discharge or outlet line.

While it is apparent that the invention herein disclosed is well calculated to fulfill the objects stated above, it will be appreciated that numerous modifications and embodiments may be devised by those skilled in the art, and it is intended that the appended claims cover all such modifications and embodiments as fall within the true spirit and scope of the present invention.

What is claimed is:

1. A compressor assembly comprising:

a central section defining a cylinder chamber;

a cylinder head secured to the central section of the compressor assembly, and defining a suction cavity and a muffler recess, the suction cavity being in communication with the cylinder chamber, and the muffler recess including a locking portion extending beneath a locking surface of the cylinder head; and a suction muffler extending into and secured within the muffler recess in pressure engagement with the surfaces of the cylinder head defining the muffler recess, defining a fluid flow path for conducting vapor into the suction cavity, and including flange means extending into the locking portion of the muffler recess, beneath the locking surface of the cylinder head to limit movement of the suction muffler away from the cylinder head.

2. The compressor assembly as defined by claim 1 wherein the flange means is in a tight pressure fit with the locking surface of the cylinder head.

3. The compressor assembly as defined by claim 1 wherein the suction muffler further includes:

a body; and a resilient member disposed within the body and urging lower portions thereof into pressure engagement with the surfaces of the cylinder head defining the muffler recess.

4. The compressor assembly as defined by claim 3 wherein the suction muffler further includes a stop connected to the body to limit upward movement of the resilient member therewithin.

5. The compressor assembly as defined by claim 1 wherein an outside surface of the central section of the compressor assembly is in pressure engagement with a front surface of the suction muffler and urges the suction muffler into pressure engagement with the surfaces of the cylinder head defining the muffler recess.

6. A method of attaching a suction muffler to a compressor assembly including a central section, a cylinder head, and a suction muffler, the method comprising the steps of:

positioning a portion of the suction muffler within a muffler recess defined by the cylinder head;

squeezing the suction muffler between surfaces of the central section of the compressor assembly and surfaces of the cylinder head defining the muffler recess to secure the suction muffler within the muffler recess; and securing the cylinder head to the central section of the compressor assembly.

7. The method as defined by claim 6 wherein the positioning step includes the step of sliding a locking flange of the suction muffler beneath a portion of the surface of the cylinder head defining the muffler recess.

8. The method as defined by claim 7 further comprising the step of inserting a resilient member within a body of the suction muffler to urge lower portions of the suction muffler body outward.

9. The compressor assembly as defined by claim 5 wherein:

the suction muffler is formed from a resilient material; and the suction muffler is squeezed between the outside surface of the central section of the compressor assembly and the surfaces of the cylinder head defining the muffler recess.

* * * * *